US008259965B2

(12) United States Patent
Chen

(10) Patent No.: US 8,259,965 B2
(45) Date of Patent: Sep. 4, 2012

(54) LOUDSPEAKER DEVICE WITH SOUND ENHANCING STRUCTURE

(75) Inventor: Chih-Hua Chen, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 234 days.

(21) Appl. No.: 12/843,072

(22) Filed: Jul. 26, 2010

(65) Prior Publication Data

US 2011/0228968 A1 Sep. 22, 2011

(30) Foreign Application Priority Data

Mar. 16, 2010 (CN) ..... 2010 1 0124888

(51) Int. Cl.
*H04R 1/02* (2006.01)

(52) U.S. Cl. ..... 381/160; 381/387; 181/191

(58) Field of Classification Search ..... 381/160, 381/387, 398; 181/191
See application file for complete search history.

(56) References Cited

U.S. PATENT DOCUMENTS 1,745,599 A * 2/1930 Brown ..... 181/171
1,786,279 A * 12/1930 Wolff ..... 181/155
3,500,953 A * 3/1970 Lahti ..... 181/151
4,348,750 A * 9/1982 Schwind ..... 367/140
4,358,835 A * 11/1982 Fage ..... 367/87
5,148,176 A * 9/1992 Beattie et al. ..... 342/104
5,220,608 A * 6/1993 Pfister ..... 381/17
5,802,193 A * 9/1998 Kieltyka ..... 381/386
5,821,470 A * 10/1998 Meyer et al. ..... 181/155
6,031,920 A * 2/2000 Wiener ..... 381/160
6,134,332 A * 10/2000 Wiener ..... 381/160
6,603,862 B1 * 8/2003 Betts ..... 381/336
2009/0202099 A1 * 8/2009 Hsu et al. ..... 381/387

* cited by examiner

*Primary Examiner* — Jeremy Luks
(74) *Attorney, Agent, or Firm* — Altis Law Group, Inc.

(57) ABSTRACT

A loudspeaker device comprising: a loudspeaker and a reflecting member positioned opposite to the loudspeaker, the loudspeaker comprising an electromagnet actuator, a dish-like frame and a vibrating drum, the electromagnetic actuator being attached on one side of the frame, the vibrating drum adhered to an inner side of the dish-like frame, the electromagnetic actuator being configured for driving the vibrating drum to vibrate, the vibrating drum being configured for generating sound of different frequencies and intensities; and the reflecting member shaped in a bowl configuration, comprising a concave shaped reflecting surface opposite to the vibrating drum; wherein the area of the reflecting surface is larger than an area of the vibrating drum.

10 Claims, 4 Drawing Sheets

LOUDSPEAKER DEVICE WITH SOUND ENHANCING STRUCTURE

BACKGROUND

1. Technical Field

The present disclosure generally relates to loudspeaker devices and, particularly, to a loudspeaker device with a sound enhancing structure.

2. Description of Related Art

Generally, the sound of loudspeakers broadcasts omnidirectionally. The sound pressure thereof may not be collected enough for a person standing at a specific position. Thus, the person may not hear clearly.

Therefore, it is desirable to provide a loudspeaker device which can overcome the limitations described.

DETAILED DESCRIPTION

Figure 1:
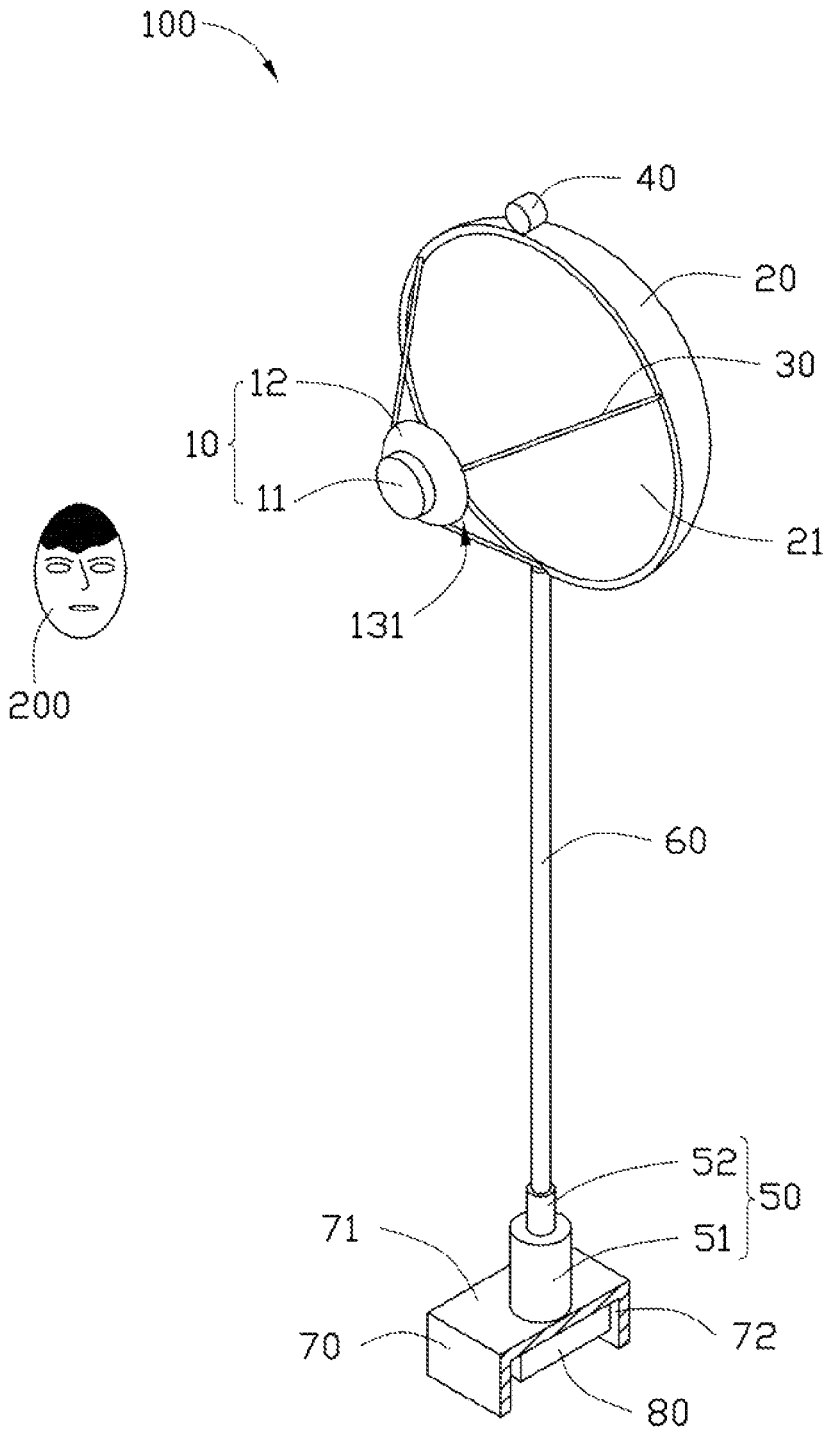
FIG. 1 is a schematic, isometric view of a loudspeaker device, according to an exemplary embodiment of the present disclosure.

Referring to FIG. 1, a loudspeaker device 100, according to an exemplary embodiment of the present disclosure, includes a loudspeaker 10, a reflecting member 20, a plurality of connecting members 30, a surveillance device 40, a driving member 50, a supporting rod 60, a base 70, and a controlling module 80.

The loudspeaker 10 is connected to the reflecting member 20 through the connecting members 30. One end of the supporting rod 60 is connected to the reflecting member 20, and the other end is engaged with the driving member 50. The driving member 50 is positioned on the base 70. The control module 80 is accommodated in the base 70.

Figure 2:
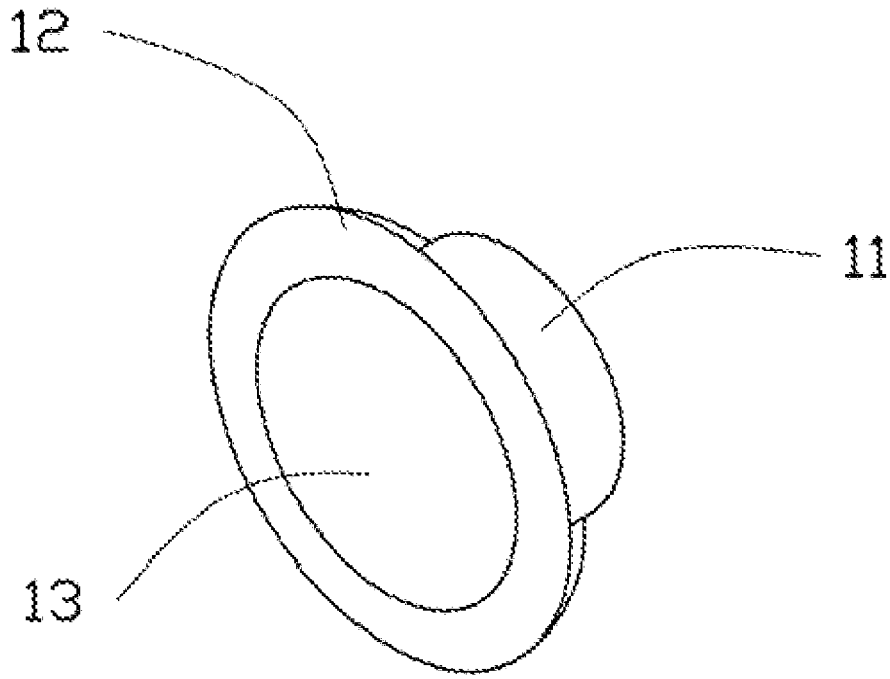
FIG. 2 is a schematic, isometric view of the loudspeaker of the loudspeaker device of FIG. 1.

Referring to FIG. 2, the loudspeaker 10 comprises an electromagnetic actuator 11, a dish-like plate 12, and a vibrating drum 13. The electromagnetic actuator 11 is attached on one side of the dish-like plate 12 by an adhesive. The vibrating drum 13 is adhered to the inner side of the plate 12 opposite to the electromagnetic actuator 11 and communicates with the electromagnetic actuator 11 through the dish-like plate 12. The electromagnetic actuator 11 is configured for producing vibration and driving the vibrating drum 13 to vibrate. The vibrating drum 13 is configured for generating sound of different frequencies and intensities when vibrating.

The reflecting member 20 is a bowl configuration and made of acoustic resistant material. The reflecting member 20 is comprised of a concave shaped reflecting surface 21. The reflecting surface 21 faces and is coaxial with the vibrating drum 13. The area of the reflecting surface 21 is lager than that of the vibrating drum 13. In the present embodiment, the area of the reflecting surface 21 is at least 50 times as large as that of the vibrating drum 13. The reflecting surface 21 can be a specular surface which can further improve the reflecting effect. Due to the use of the reflecting member 20, the sound generated by the vibrating drum 13 becomes directional.

The connecting members 30 are three shafts, each of which has two ends. One end of each of the shafts is connected to the edge of the dish-like frame 12 by soldering or other adhering method, and the other end is connected to the edge of the reflecting member 20.

The surveillance device 40 is mounted on the edge of the reflecting member 20 and faces the vibrating drum 13, that is, the surveillance device 40 and the reflecting member 20 point to the same direction. The surveillance device 40 is configured for capturing images.

The driving member 50 is mounted on the base 70 and comprises a stator 51 and a rotor 52. The stator 51 is configured for driving the rotor 52 to rotate. The rotor 52 is connected to the supporting rod 60 and configured for rotating the supporting rod 60 along with the rotor 52.

The supporting rod 60 may be made of metal or other materials. One end of the supporting rod 60 is connected to an edge of the reflecting member 20, and the other end of the supporting rod 60 is connected to the rotor 52.

The base 70 defines an upper plate 71 and sidewalls 72. The sidewalls 72 extend down from edges of the upper plate 71. The upper plate 71 and sidewalls 72 cooperatively define a space.

The controlling device 80 is accommodated in the space formed by the upper plate 71 and sidewalls 72. The controlling device 80 is electrically coupled with the surveillance device 40 and the driving member 50. The controlling module 80 is configured for recognizing a human face from the images captured by the surveillance device 40, and controlling the driving member 50 to rotate the supporting rod 60 such that the surveillance device 40 and the reflecting member 20 point to the human face. Understandably, the rotor 52 will drive the supporting rod 60 and the reflecting member 20 connected with the supporting rod 60 to rotate.

In use, the loudspeaker 10 generates sound for a user 200. The driving member 50 drives the surveillance device 40 to rotate. The surveillance device 40 captures images when rotating and transmits the images to the controlling module 80. When the controlling module 80 recognizes a human face from the images, the controlling module 80 controls the driving member 50 to rotate the supporting rod 60 such that the surveillance device 40 and the reflecting member 20 point to the user. Therefore, the sound generated by the vibrating drum 13 is mainly broadcasted toward the user.

When the images comprise more than one human face and if the human faces appear in a certain area, the controlling module 800 controls the driving member 50 to rotate the supporting rod 60 such that the reflecting member 20 points to the center of the area. If the users are scattered around the supporting rod 60, the reflecting member 20 is controlled to point to the users in turn.

Figure 3:
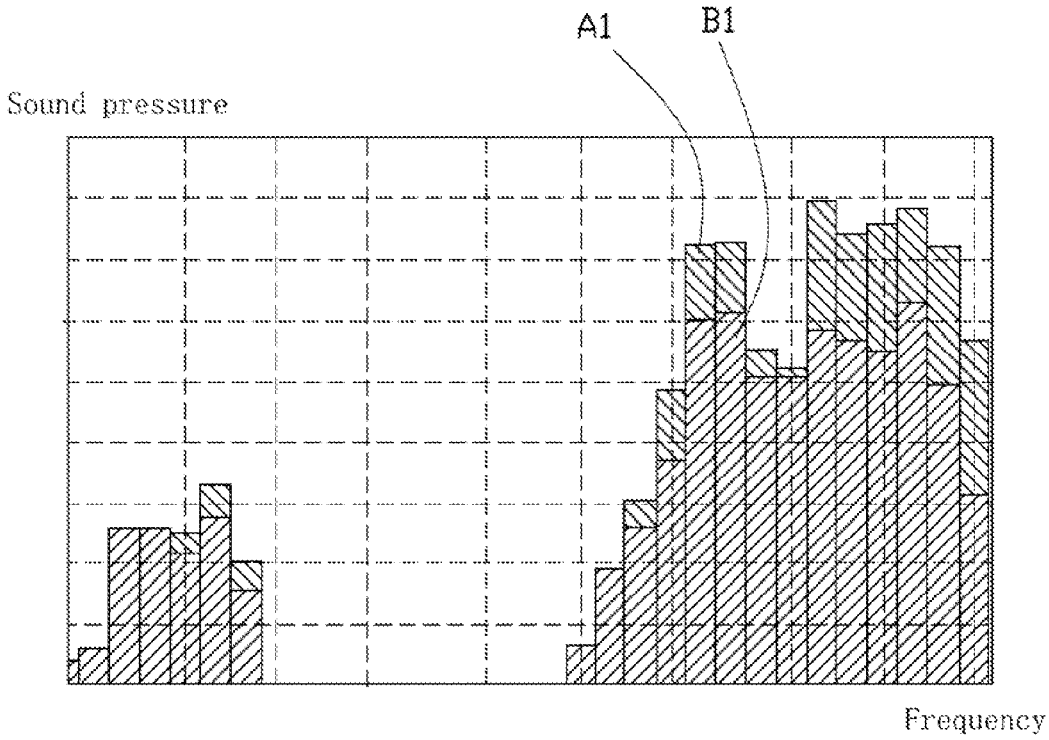
FIG. 3 is a graph showing the sound pressure curves of the loudspeaker device of FIG. 1 compared to a conventional loudspeaker device.

FIG. 3 is a graph showing sound pressures of the loudspeaker device 100 and a conventional loudspeaker device around a user, where A1 denotes the sound pressure of the loudspeaker device 100, B1 denotes the sound pressure of the conventional loudspeaker device. As shown in FIG. 3, A1 is much higher than B1 between a middle and high frequency area (1000 Hz-20 KHz), it indicates that the sound wave generated by the loudspeaker 100 is directionally transmitted, and the sound pressure around the user is greatly enhanced.

Figure 4:
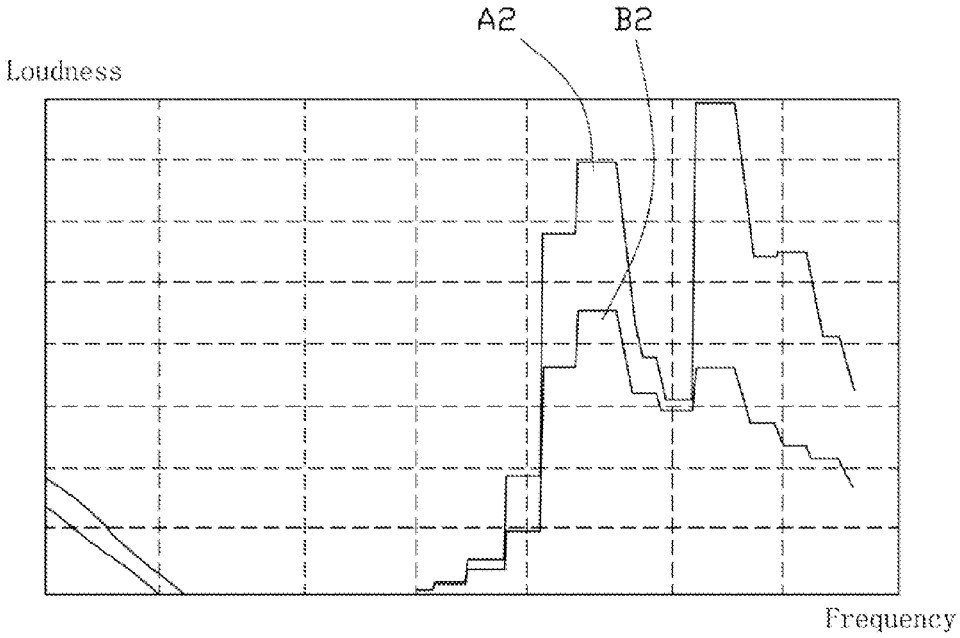
FIG. 4 is a graph showing the loudness curves of the loudspeaker device of FIG. 1 compared to a conventional loudspeaker device.

FIG. 4 is a graph showing the loudness of the loudspeaker device 100 and a conventional loudspeaker device around a user, where A2 denotes the loudness of the loudspeaker 100, B2 denotes the loudness of the conventional loudspeaker device. As illustrated in FIG. 3, A2 is much higher than B2 during the middle and high frequency area (1000 Hz-20

KHz), it is indicated that the sound wave generated by the loudspeaker device 100 is directionally transmitted.

It is to be understood, however, that even though numerous characteristics and advantages of the disclosure have been set forth in the foregoing description, together with details of the structures and functions of the embodiment(s), the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A loudspeaker device, comprising:

a loudspeaker and a reflecting member positioned opposite to the loudspeaker, the loudspeaker comprising an electromagnet actuator, a dish-like frame and a vibrating drum, the electromagnetic actuator being attached on one side of the frame, the vibrating drum adhered to an inner side of the dish-like frame opposite to the electromagnet actuator and communicating with the electromagnetic actuator, the electromagnetic actuator being configured for driving the vibrating drum to vibrate, the vibrating drum being configured for generating sound of different frequencies and intensities; and the reflecting member shaped in a bowl configuration, comprising a concave shaped reflecting surface opposite to the vibrating drum; and a surveillance device mounted on an edge of the reflecting member, the surveillance device and the reflecting surface of the reflecting member pointing to the same direction;

wherein the area of the reflecting surface is larger than an area of the vibrating drum.

2. The loudspeaker device of claim 1, wherein the area of the reflecting surface is at least 50 times as large as the area of vibrating drum.

3. The loudspeaker device of claim 1, further comprising at least one connecting member for connecting an edge of the sound generating member and the edge of the reflecting member.

4. The loudspeaker device of claim 1, further comprising a holding rod, a driving member configured for driving the holding rod to rotate, wherein one end of the holding rod is connected with the reflecting member, and the other end is connected to the driving member.

5. The loudspeaker device of claim 4, further comprising a controlling module electrically coupled with the surveillance device and the driving member, and configured for recognizing human face from images captured by the surveillance device, and controlling the driving member to rotate to orient the loudspeaker device.

6. The loudspeaker device of claim 4, further comprising a base having an upper plate and sidewalls extending down from the upper plate, wherein the upper plate and sidewalls cooperatively formed a space for accommodating the controlling module.

7. The loudspeaker device of claim 1, wherein the reflecting member is made of acoustic resistant material.

8. A loudspeaker device, comprising:

a loudspeaker comprising an electromagnet actuator, a dish-like frame and a vibrating drum, the electromagnetic actuator being attached on one side of the dish-like frame, the vibrating drum adhered to an inner side of the dish-like frame opposite to the electromagnet actuator and communicating with the electromagnet actuator, the electromagnetic actuator being configured for driving the vibrating drum to vibrate, the vibrating drum being configured for generating sound of different frequencies and intensities; and a reflecting member shaped in a bowl configuration, comprising a concave shaped reflecting surface opposite to the vibrating drum, and a surveillance device mounted on an edge of the reflecting member, the surveillance device and the reflecting surface of the reflecting member pointing to the same direction;

wherein the area of the reflecting surface is larger than the area of vibrating drum, and the reflecting surface is configured for gathering sound and directly reflecting sound.

9. The loudspeaker device of claim 8, wherein the area of the reflecting surface is at least 50 times as large as the area of vibrating drum.

10. The loudspeaker device of claim 8, wherein the reflecting member is made of acoustic resistant material.

* * * * *